US005149909A

United States Patent [19]

Hagen et al.

[11] Patent Number: 5,149,909

[45] Date of Patent: Sep. 22, 1992

[54] OPPOSED ROUND PARALLEL PATH SINGLE BAY AMMUNITION FEED SYSTEM

[75] Inventors: Richard L. Hagen, Villa Park; William C. Baldwin, Costa Mesa; William W. Thompson, Fountain Valley, all of Calif.

[73] Assignee: North American Dynamics, Tustin, Calif.

[21] Appl. No.: 714,572

[22] Filed: Jun. 13, 1991

[51] Int. Cl.[5] ..... F41A 9/69

[52] U.S. Cl. ..... 89/33.16; 89/34; 89/33.17

[58] Field of Search ..... 89/34, 33.16, 31.17, 89/35.01

[56] References Cited

U.S. PATENT DOCUMENTS

| | | | |
|---|---|---|---|
| 3,583,276 | 6/1971 | Murray et al. | 89/34 |
| 3,720,301 | 3/1973 | Garland et al. | 89/33.16 |
| 3,747,469 | 7/1973 | Ashley et al. | 89/34 |
| 4,424,735 | 1/1984 | Bacon et al. | 89/34 |
| 4,474,102 | 10/1984 | Tassie | 89/33.17 |
| 4,573,395 | 3/1986 | Stoner | 89/33.16 |
| 4,833,966 | 5/1989 | Maher et al. | 89/33.16 |
| 4,876,940 | 10/1989 | Aloi et al. | 89/33.16 |
| 4,881,447 | 11/1989 | Yanusko et al. | 89/34 |
| 4,882,972 | 11/1989 | Raymond | 89/34 |
| 4,982,650 | 1/1991 | Bender-Zanoni et al. | 89/34 |

*Primary Examiner*—David H. Brown

*Attorney, Agent, or Firm*—Price, Gess & Ubell

[57] ABSTRACT

An ammunition feed system wherein a single layer of alternatingly opposing rounds of ammunition is conveyed in a magazine by a single closed loop conveyor disposed along a serpentine path. The opposing rounds are fed into a twister conveyor apparatus which aligns the rounds and conveys the aligned rounds onto a pair of parallel paths. The aligned rounds on the parallel paths are received by a pair of feed rotors for alternate insertion into a single gun feeding conveyor. Spent rounds are withdrawn from the conveyor by a pair of return rotors, which return the spent rounds to a second twister conveyor. The second twister conveyor reorients the rounds into an alternating opposed configuration and returns the rounds to the serpentine path. Each twister conveyor includes two pairs of sprockets oriented in a perpendicular configuration. Each pair of sprockets carries one closed loop of conveyor elements for conveying rounds. The perpendicular orientation of the sprockets produces a 90-degree rotation of rounds conveyed on the respective conveyor assembly.

16 Claims, 10 Drawing Sheets

OPPOSED ROUND PARALLEL PATH SINGLE BAY AMMUNITION FEED SYSTEM

BACKGROUND OF THE INVENTION

1. Field of the Invention

The subject invention relates to ammunition feed systems and, more particularly, to a feed system and associated magazine providing continuous positive round control at firing rates of on the order of 6,000 rounds per minute, wherein the effective feed rate is doubled over the transfer rate of the magazine and wherein the packaging density is maximized. Hereinafter, rounds of ammunition may be referred to interchangeably as rounds, cartridges, bullets, or ammunition.

2. Description of Related Art

The existing armament system of a typical fighter aircraft feeds a gun operating at 6,000 rounds per minute, which translates to 100 rounds per second. The arrangement uses a drum-like feed unit disposed under the gun, which employs a helical feed and pickoff of rounds to achieve the required high feed rate. The ammunition is radially disposed about a helical member within the drum container, and when the unit is operated, the helix acts as a jackscrew, forcing ammunition from the drum at the desired rate. The drum-like unit takes up an exact cylindrical space, affording no flexibility of the installation envelope. In many cases a cylinder does not offer optimum packaging density, and it has appeared that additional space for avionics could be gained by employing a linear linkless ammunition feed system.

Linear linkless systems offer a very high packaging density which results from transporting rounds in a flexible ladder-type conveyor routed in serpentine fashion through adjacent linear paths in the magazine structure. While linear linkless systems are very space efficient, the operational rate of a conventional system matches the 100-round-per-second feed rate, resulting in tremendous wear and tear on the system and a large horsepower drive requirement.

Prior art is known which offers a partial solution to the high operating rate of a linear linkless system by placing rounds in two joined rows, nose to base, and moving transversely to the round axis. This double row conveyor arrangement is commonly referred to as a two-bay linear linkless magazine, and it operates at one-half of the gun rate. The drawback to this arrangement is that the two-bay width must be some percentage longer than two cartridge lengths and therefore is not applicable to installations requiring a narrow profile.

SUMMARY OF THE INVENTION

Accordingly, it is an object of the invention to improve ammunition feed systems;

It is another object of the invention to provide an ammunition feed system which conserves space and power;

It is another object of the invention to provide an ammunition feed system wherein the feed rate is much higher than the system operating rate;

It is another object of the invention to provide an ammunition feed system where the effective feed rate to the gun is on the order of 6,000 rounds per minute and is twice the operating rate of the magazine;

It is another object of the invention to provide an ammunition feed system having the operational benefits of a two-bay system, yet having the packaging versatility of a single bay system; and It is another object of the invention to provide such a system which can withstand high "g" forces and other stresses of a tactical environment.

These and other objects and advantages are achieved by providing an ammunition feed system wherein a single layer of alternatingly opposing rounds of ammunition is conveyed in a magazine by a single closed loop conveyor disposed along a serpentine path. The opposing rounds are fed into a twister conveyor apparatus which aligns the rounds and conveys the aligned rounds onto a pair of paths. The aligned rounds on the paths are received by a pair of feed rotors for alternate insertion into a single gun feeding conveyor. Spent rounds are withdrawn from the conveyor by a pair of return rotors, which return the spent rounds to a second twister conveyor. The second twister conveyor reorients the rounds into an alternating opposed configuration and returns the rounds to the serpentine path.

In a preferred embodiment, the pair of paths are parallel. Each twister conveyor includes two pairs of sprockets oriented in a perpendicular configuration. Each pair of perpendicular sprockets carries one closed loop conveyor chain for conveying rounds. The perpendicular orientation of the sprockets produces a 90-degree rotation of rounds conveyed on the respective conveyor chains.

The linear linkless approach of the system allows high form factor flexibility. Rounds can be oriented along any axis that provides the best packaging density for the particular armament bay configuration. Adjacent rounds can be stored in a magazine with opposing orientations to achieve denser packing.

As noted above, a conventional linear linkless system is a single bay system requiring the entire ammunition complement to operate at the maximum gun rate of 6,000 shots per minute. The high rate greatly increases required aircraft power and results in a heavier, more expensive, and less reliable mechanism.

There are many applications where the packaging efficiency of a single bay system would be highly desirable if it were not for the restriction of high operating rates in the magazine. The invention provides the operational benefits of a two-bay system while providing the superior packaging density of a single bay system.

BRIEF DESCRIPTION OF THE DRAWINGS

The just-summarized invention, both as to its organization and manner of operation, together with further objects and advantages, may best be understood by reference to the following detailed description of the preferred embodiment, taken in connection with the accompanying drawings, of which.

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a particularly efficient ammunition feed system.

Figure 1:
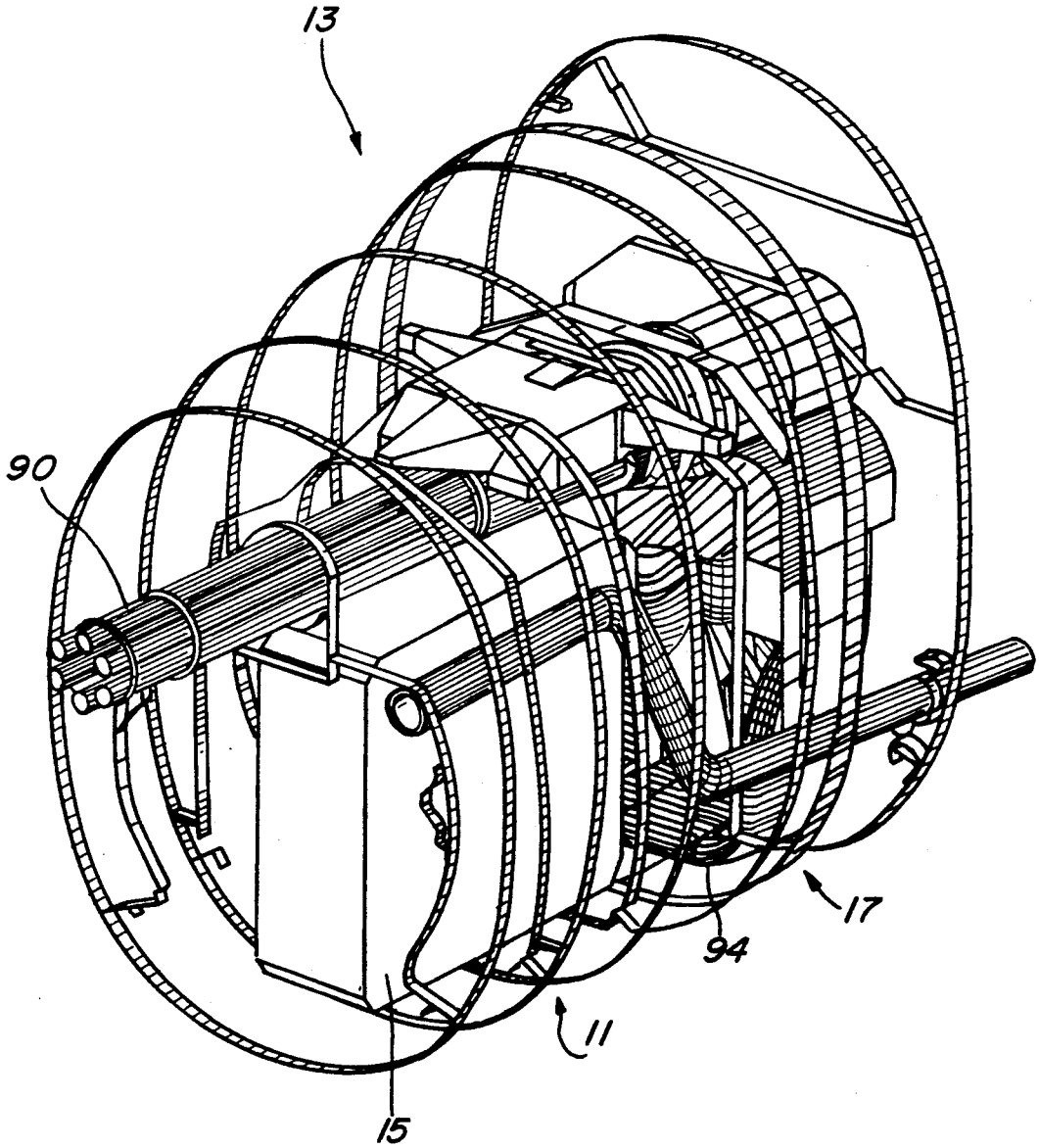
FIG. 1 is a side perspective illustrating an ammunition feed system including an ammunition magazine according to the preferred embodiment in operational position.

FIG. 1 illustrates a preferred ammunition feed system 11 disposed in an aircraft nose section beneath the barrel 90 of a gun 13. Feed system 11 includes a single bay magazine section 15, two twister conveyors (not shown), and a round path integrator section 17. A conventional flex chute 94 exits gun 13 to return ammunition to magazine 15.

Figure 2A:
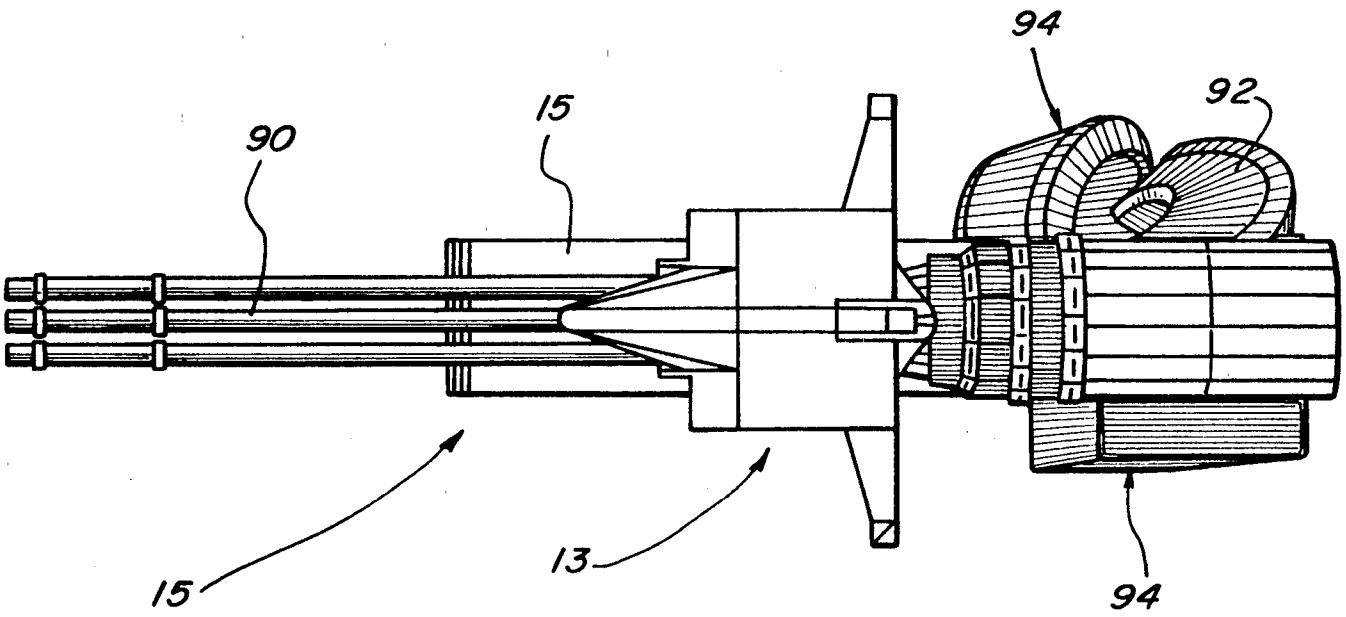
FIGS. 2*a* and 2*b* are top and front views, respectively, of the embodiment of FIG. 1.
Figure 2B:
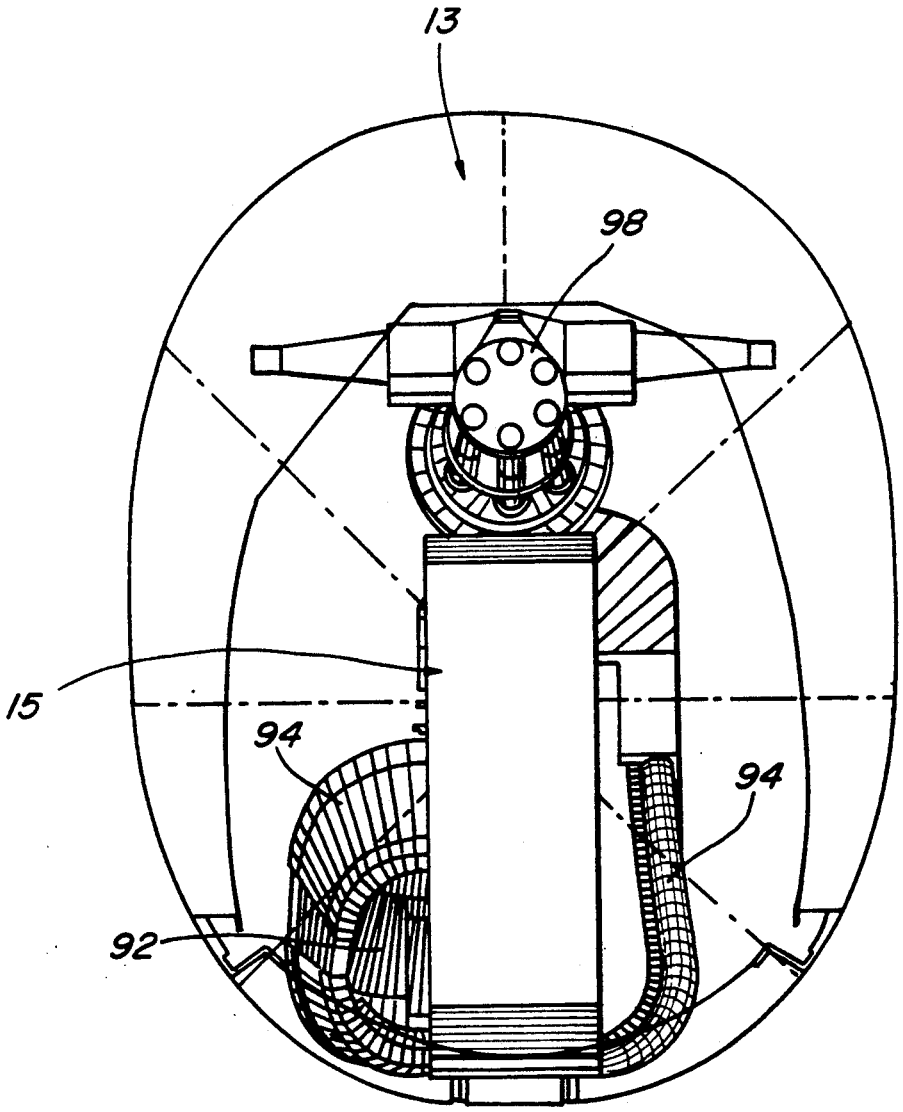

FIGS. 2*a* and 2*b* illustrate feed system 11 disposed beneath the centerline of nose barrel 90 of gun 13. Also shown are a feed chute 92 for feeding ammunition from magazine 15 to gun 13 and return chute 94 for returning ammunition to magazine 15.

The advantages of locating feed system 11 directly beneath barrel 90 include: feed system installation and removal procedures are identical; the swept volume for removing feed system 11 is not much greater than that of gun barrel 90; electronic equipment need not be removed or moved for feed system removal and installation; and the overall height of ammunition magazine 15 is maximized by the centerline location.

Figure 3:
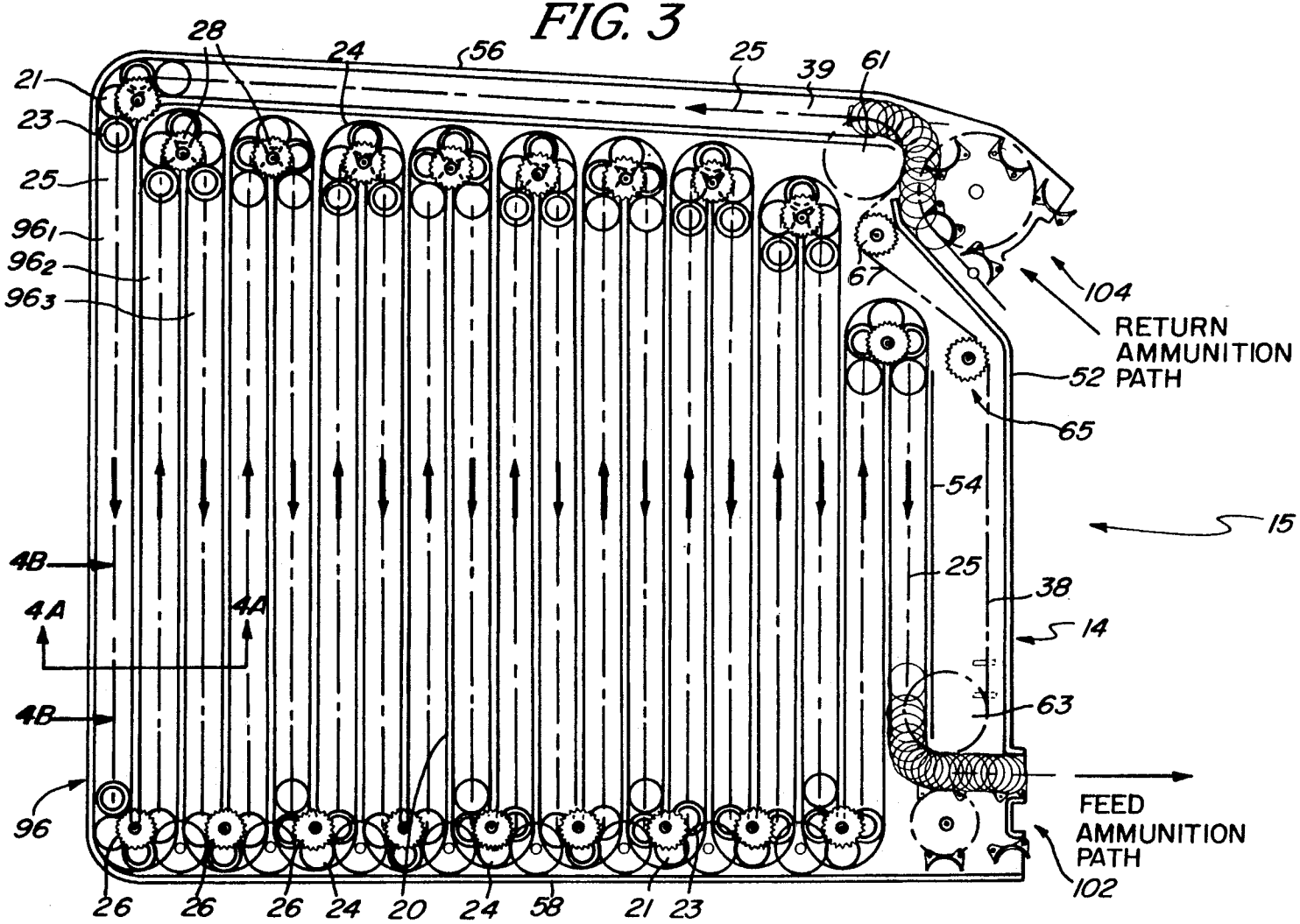
FIG. 3 is a side schematic view of the ammunition magazine of FIG. 1 with cover removed.

FIG. 3 illustrates magazine 15 in more detail. As may be seen, the magazine is loaded with a single layer of rounds 21 and 23 of ammunition. Rounds 21, 23 are disposed vertically (perpendicular to the plane of the paper) in a single serpentine, linkless, linear channel 25 with alternating opposing orientations, i.e., rounds are alternatingly nose down or nose up. Nose-down rounds 21 are shown as single circles, while opposing nose-up rounds 23 are shown as concentric circles. The direction of movement of the rounds 21, 23 is shown generally by the arrows on FIG. 3.

For clarity, only exemplary sections of channel 25 are shown as being filled with rounds 21, 23; in use, however, the entire serpentine channel 25 is preferably loaded with rounds.

The fresh (unfired) rounds 21, 23 travel along serpentine channel 25, where they are transferred from serpentine channel 25 into a twister conveyor 102. Rounds 21, 23, provided in alternating opposing orientation in serpentine channel 25, are aligned by a twister conveyor 102 and transferred to separate parallel paths. The thus-aligned rounds 21, 23 provided on the parallel paths are received by an integrating rotor assembly (described below) which combines rounds 21, 23 onto a single path for feeding into gun assembly 13. Spent rounds output from gun 13 (FIG. 1) are received by a second integrator rotor assembly, which receives the single series of aligned rounds from gun 13 and separates the rounds onto two parallel paths. Rounds 21, 23, provided on the two parallel paths, are then fed to a second twister conveyor 104 which returns rounds 21, 23 to opposing, alternating orientations and inserts rounds 21, 23 into horizontal channel 39. Identical twister conveyors and integrator rotor assemblies are used for both the feed and return paths from gun 13.

The magazine's serpentine conveyor system transports the rounds along the parallel paths in the directions shown, and preferably employs a conventional chain ladder drive system 14. Other than sprockets, e.g., 61, 63, and a conveyor chain 38, the ladder conveyor system is not illustrated in detail in FIG. 3 for clarity. A suitable spring tension apparatus includes chain tensioner sprockets 65 and 67 to take up slack in the ladder system which may occur on start-up. Alternatively, the tension apparatus may comprise, for example, a spring biased plate mounting the sprockets and linearly slidable in a slot parallel to the arrows shown in FIG. 3. A wire rope ladder drive system may also prove applicable such as that disclosed in U.S. Pat. No. 4,941,393, issued Jul. 17, 1990, incorporated by reference herein.

Feed system 11 is described in detail below with reference to individual subsystems.

AMMUNITION MAGAZINE

Figure 4A:
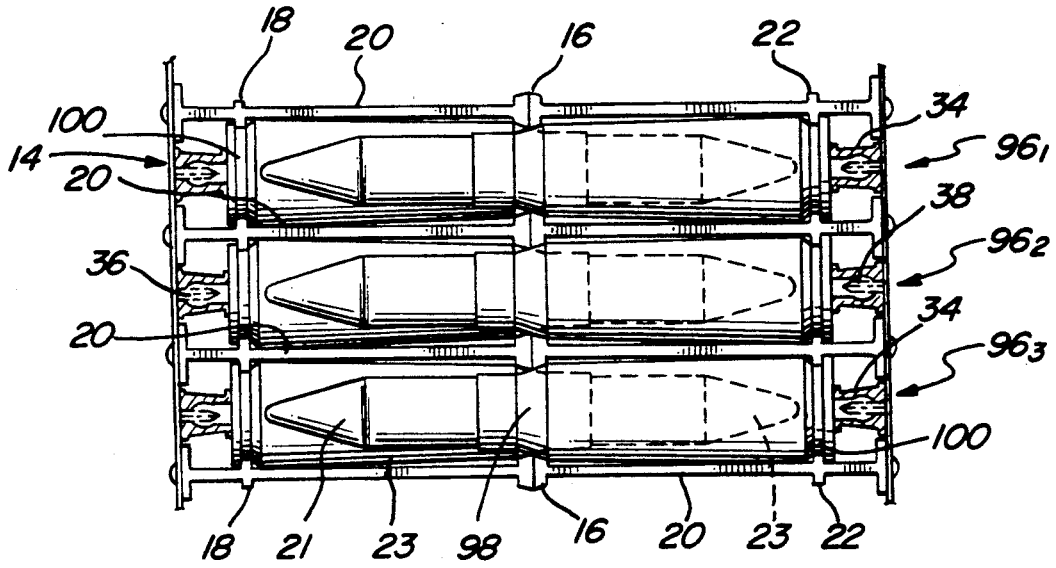
FIGS. 4*a* and 4*b* are side and front views, respectively, of a section of the ammunition magazine of FIG. 3 taken along lines A—A and B—B of FIG. 3, respectively.
Figure 4B:
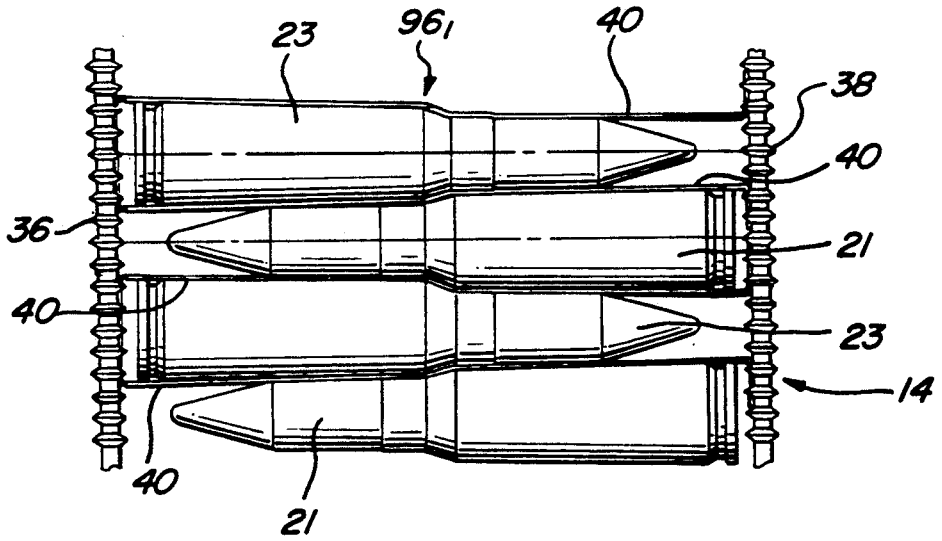
Figure 5:
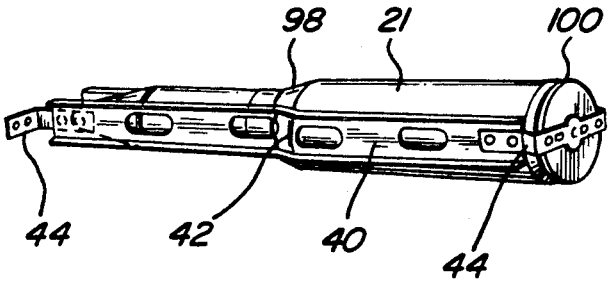
FIG. 5 is a perspective view of a crossbeam assembly of FIG. 4*b*.

Referring to FIGS. 3 through 5, ammunition magazine 15 and its components are shown in detail. Ammunition rounds are retained in a nose-to-nose orientation within a serpentine channel 25. Rounds 21, 23 are retained at one-inch-pitch intervals between rounds.

Serpentine channel 25 includes an upper path 39 and a series of adjacent vertical rows generally denoted 96. A total of 19 vertical rows 96 are shown with exemplary rows identified as $\mathbf{96}_1$, $\mathbf{96}_2$, and $\mathbf{96}_3$.

Rounds 21, 23 are transported within serpentine channel 25 by endless chain ladder conveyor 14.

Exemplary vertical rows $\mathbf{96}_1$, $\mathbf{96}_2$, and $\mathbf{96}_3$ are shown in detail in FIG. 4*a*. FIG. 4*a* is a vertical view looking down along the length of the vertical rows. A front view of exemplary channel $\mathbf{96}_1$ is shown in FIG. 4*b*.

Adjacent rows $\mathbf{96}_1$, $\mathbf{96}_2$, and $\mathbf{96}_3$ are separated by partitions 20, which include round guide surfaces 16 at center of partitions 20. Guide surfaces 16 contact a tapered shoulder 98 of an ammunition round 21, 23.

In FIG. 4*a*, the hidden nose sections of opposing rounds 23 are shown in phantom lines.

Two additional round guide surfaces 18, 22 are provided which project from partitions 20 at locations aligned with extractor grooves 100 of rounds 21, 23. Guides 18, 22 contact the inside diameter of extractor groove 100 and, thus, rounds 21, 23 are supported at both tapered shoulder 98 and extractor groove 100. Thus, the round is supported two places at equal diameters, which allows rounds 21, 23 to roll in a straight line along each row 96, reducing friction, and thereby also reducing required driving force to a minimum.

Returning to FIG. 3, the construction of magazine 15 is simple and straightforward: front and rear panels (not shown) support extruded partition members 20 which form channel 25. Idler sprockets, generally denoted 26, 28, with associated round guides 24, are provided at the respective ends of parallel rows 96 within channel 25, and provide turnarounds for rounds 21, 23 conveyed within channel 25.

To reduce drag within channel 25, rows 96 are oriented vertically. This vertical configuration minimizes any surge in power demand caused by positive "G" forces induced as a result of aircraft maneuvering; i.e., the forces on rounds 21, 23 carried on adjacent rows 96 tend to cancel.

Two drive sprockets 61, 63 located aft of magazine 15 (one upper and one lower) drive the entire feed system 11. Drive sprockets 61, 63 are driven at equal rates in the counterclockwise direction and provide both a primary drive for chain ladder assembly 14, as well as a hand-on and hand-off mechanism for ammunition feed and return to be described below.

To minimize chain load, the lower turnaround assemblies 26 are driven through a spur gear arrangement (not shown) which is synchronized such that chain load is subject only to each individual run.

CHAIN LADDER ASSEMBLY

Referring again to FIGS. 4*a* and 4*b*, chain ladder assembly 14 includes two parallel chain assemblies 36, 38, preferably spaced 7.613 inches apart, cross connected by a series of crossbeams 40 preferably separated by one-inch spacings, i.e., four pitches of 0.25-inch pitch chain. Crossbeams 40 are positioned in opposing pairs at one-inch pitch to accept rounds 21, 23 in a nose-to-nose configuration.

Chain guides 34 are provided between upper and lower turnaround assemblies 26 and serve two functions, namely: (1) guides 34 provide a continuous base guide for rounds 21, 23 while in channel 25, and (2) guides 34 provide a guide for chain ladder assembly 14. Chain guides 34 are preferably comprised of material offering high strength and low friction. Since chain drag within the system contributes considerably to the total power required to drive rounds 21, 23 through magazine 15, low friction chain guides 34 reduce chain drag, and thus reduces the overall system power requirements.

Chain assemblies 36, 38 are sets of rollerless chain, preferably pretensioned during assembly to minimize chain stretch during use.

A single crossbeam 40, shown more clearly in FIG. 5 with an exemplary round 21, is constructed of one length of aluminum extrusion shaped in the form of a small "I" -beam approximately 0.60 inches high by 0.12 inches wide. A jog 42 is formed at the midpoint of crossbeam 40 to match tapered shoulder 98 of rounds 21, 23.

Crossbeams 40 are attached at every fourth pitch of chains 36, 38 by use of a small steel clip 44 riveted to a crossbeam 40 and pinned to chains 36, 38 by headed pins (not shown). Preferably, however, crossbeam 40 is injection molded from reinforced carbon fiber with end clips 44 molded in place (not shown). Injection molding of crossbeams 44 greatly reduces both weight and cost in production quantities, while also enhancing performance.

MAGAZINE PARTITION MEMBERS

Referring again to FIG. 4*a*, partitions 20 provide guiding surfaces for both rounds 21, 23 and chain assemblies 36, 38 through channel 25. Partitions 20 are extruded to form the shape shown in FIG. 4*a*. The shape of partition 20 is multifunctional, as it provides three guide surfaces, one central at shoulder 98 of rounds 21, 23, and one each at extractor groove ribs at opposing ends of rounds 21, 23. Partition 20 also provides positioning and retaining features for chain guides 34.

Referring again to FIG. 3, partitions 20 are preferably parallel and spaced at 1.361-inch intervals, i.e., equal to the pitch diameter of turnaround assemblies 26. All vertical partitions 20 are riveted in place, with the exception of the four panels 52, 54, 56, 58. Aft panels 52, 54 and upper and lower horizontal panels 56, 58 are removable for access to turnaround assemblies 26 and to drive sprockets 61, 63.

A portion of partitions 20 between guide surfaces 16, 18, 22 can selectively be removed for weight reduction. A series of such cutouts (not shown) reduces the weight of partitions 20 by 50% compared to the weight without cutouts.

The material preferred for partitions 20 is a composite pultrusion.

Thus, a combination of composite panels 20 and crossbeams 40 surround each round 21, 23, isolating the rounds from each other, thereby minimizing the potential of fragmentation damage throughout the magazine structure should one of the rounds fire while inside magazine 15.

TWISTER CONVEYOR

Figure 6:
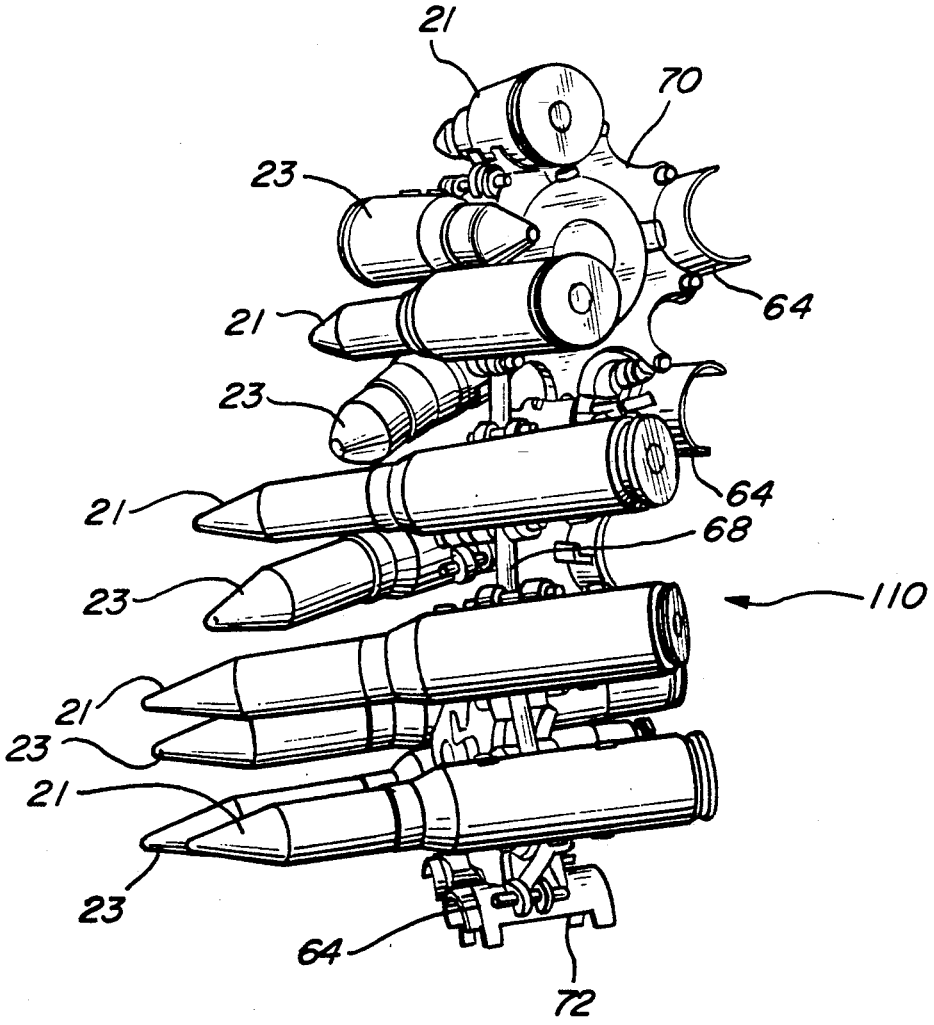
FIG. 6 is a perspective view of a twister conveyor assembly.
Figure 7:
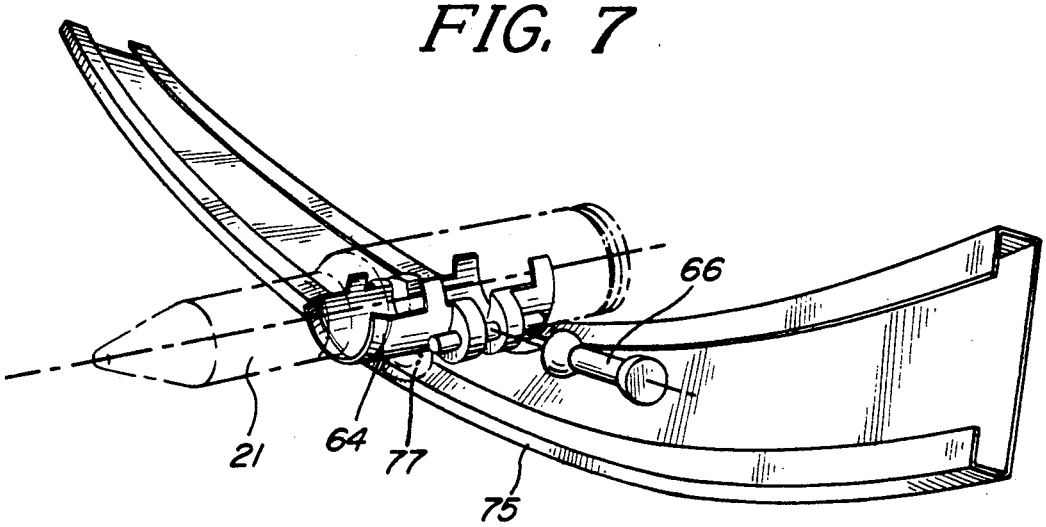
FIG. 7 is a perspective view of a single conveyor element of the twister conveyor assembly of FIG. 6.
Figure 8:
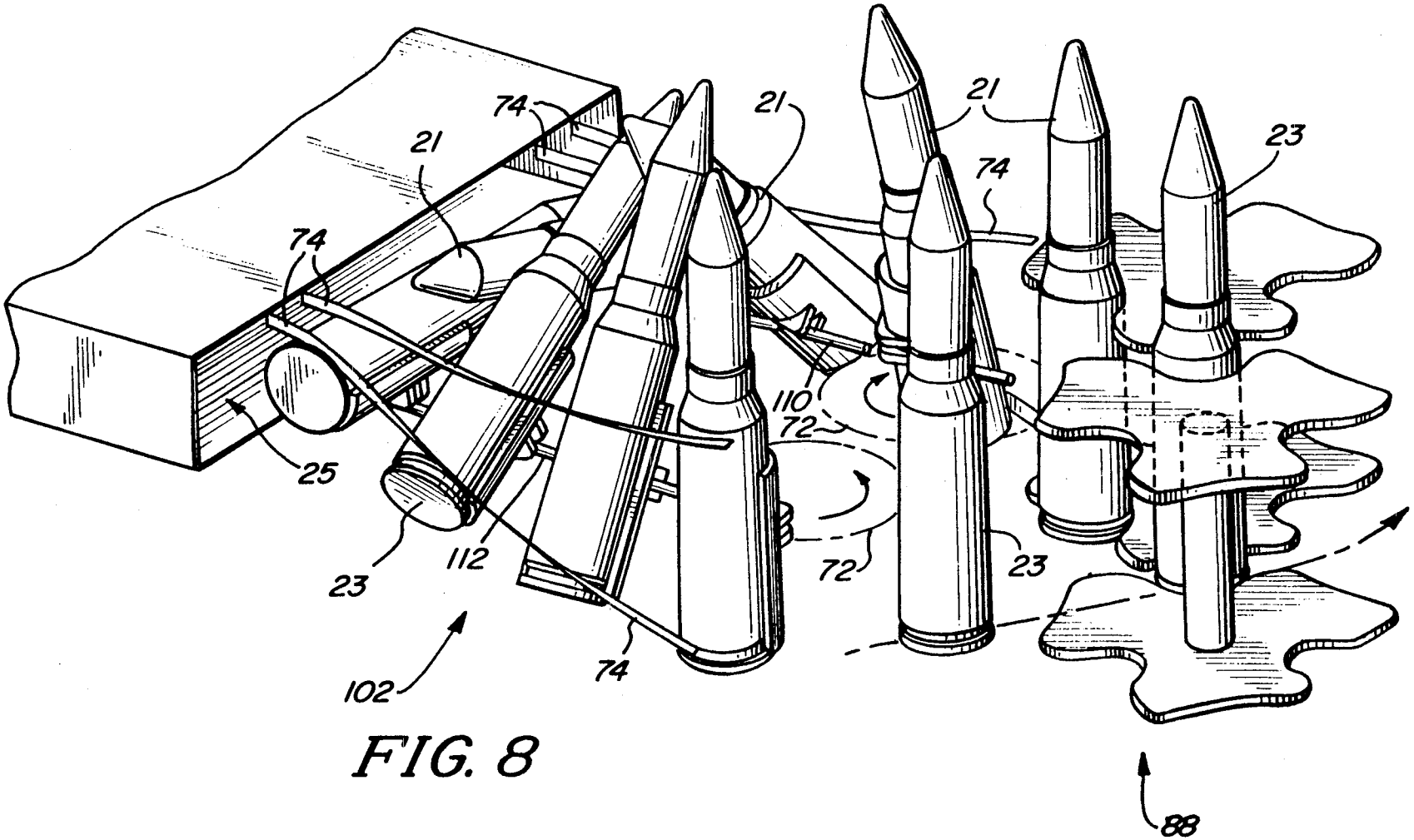
FIG. 8 is a diagram of the rotation and alignment of opposing rounds provided by the twister conveyor of the invention.

Referring to FIGS. 6 through 8, a twister conveyor will be described. Each twister conveyor 102, 104 includes a pair of twister assemblies 110, 112. Twister assemblies 110, 112 are identical, but inverted; i.e., twister assembly 110 is the mirror image of twister assembly 112. For clarity only twister assembly 110 is completely shown in FIG. 6. Twister assembly 112 is obscured and represented only by rounds 23 conveyed thereon. Twister assemblies 110 and 112 together comprise two drive sprockets 70 and two idle sprockets 72. Drive sprockets 70 are aligned coaxially and positioned at the exit of serpentine channel 25 (FIG. 3). Idle sprockets 72 are rotated 90 degrees with respect to drive sprockets 70, and are provided in a plane which is parallel with the common axis of drive sprocket 70.

Conveyor loops 68 connect each of the pairs of drive sprockets 70 and idle sprockets 72. Each conveyor loop 68 is a continuous loop which connects the respective perpendicular drive and idle sprockets 70, 72 and carries a series of conveyor elements 64, each of which is adapted to receive and convey one round 21 or 23. Twister assembly 110 receives only rounds 21 from serpentine channel 25, whereas twister assembly 112 receives only rounds 23 from serpentine channel 25. By virtue of the perpendicular configuration of drive sprocket 70 and idle sprocket 72, rounds 21 conveyed by twister assembly 110 are rotated through a 90-degree angle when conveyed from sprocket 70 to sprocket 72. Likewise, rounds 23, conveyed on conveyor loop 68 of twister assembly 112, are rotated through an opposite 90-degree angle.

Referring to FIG. 7, an exemplary individual conveyor element 64 is shown. Exemplary conveyor element 64 is connected to an adjacent conveyor element (not shown in FIG. 7) via an articulated joint 66. Each additional conveyor element 64 is attached to a subsequent element and together comprise conveyor loop 68.

Each conveyor element 64 is shaped to receive and hold a round 21 or 23. Conveyor element 64, carrying a round 21, 23, is conveyed along a guide rail 75. Guide rail 75 includes parallel slots for receiving and guiding feet 77, which depend from conveyor element 64. As can be seen from FIG. 7, guide rail 75 includes opposite ends formed with a 90-degree angle therebetween such that, as conveyor element 64 is conveyed along guide rail 75, conveyor element 64 rotates about articulated joint 66, thus allowing the round to be rotated through an angle of 90 degrees.

Rounds 21 and rounds 23 are aligned in parallel after conveyance through respective twister assemblies 110, 112. The action of twister assemblies 110, 112 are shown in FIG. 8 with reference to exemplary rounds 21, 23.

Also shown in FIG. 8 are outer round guides 74 shaped to hold rounds 21, 23 within conveyor elements 64. For clarity, each outer guide 74 is represented in FIG. 8 as comprising two separate narrow bands. However, outer round guides 74 can be constructed of any rigid member capable of bearing on the case neck and body of rounds 21, 23.

To summarize, rounds 21, 23 fed from magazine 15 are received by conveyor elements 64. Conveyor elements 64 are articulated via joints 66, enabling a round pitch increase of 50% to be attained. Articulated joints 66, provided between each element 64, permit twisting of opposing rounds 21, 23 through 90 degrees into a common orientation. Each conveyor loop 68 is carried on sprockets 70, 72, one sprocket, 70, being a driver, and one, 72, an idler. Between sprockets 70, 72, the rotation of conveyor elements 64 is controlled by guide tracks 75. Rounds 21, 23 are captivated within individual elements 64 by round guides 74 which bear on the case neck and body of each round 21, 23.

INTEGRATING ROTOR MERGER UNIT

Figure 9:
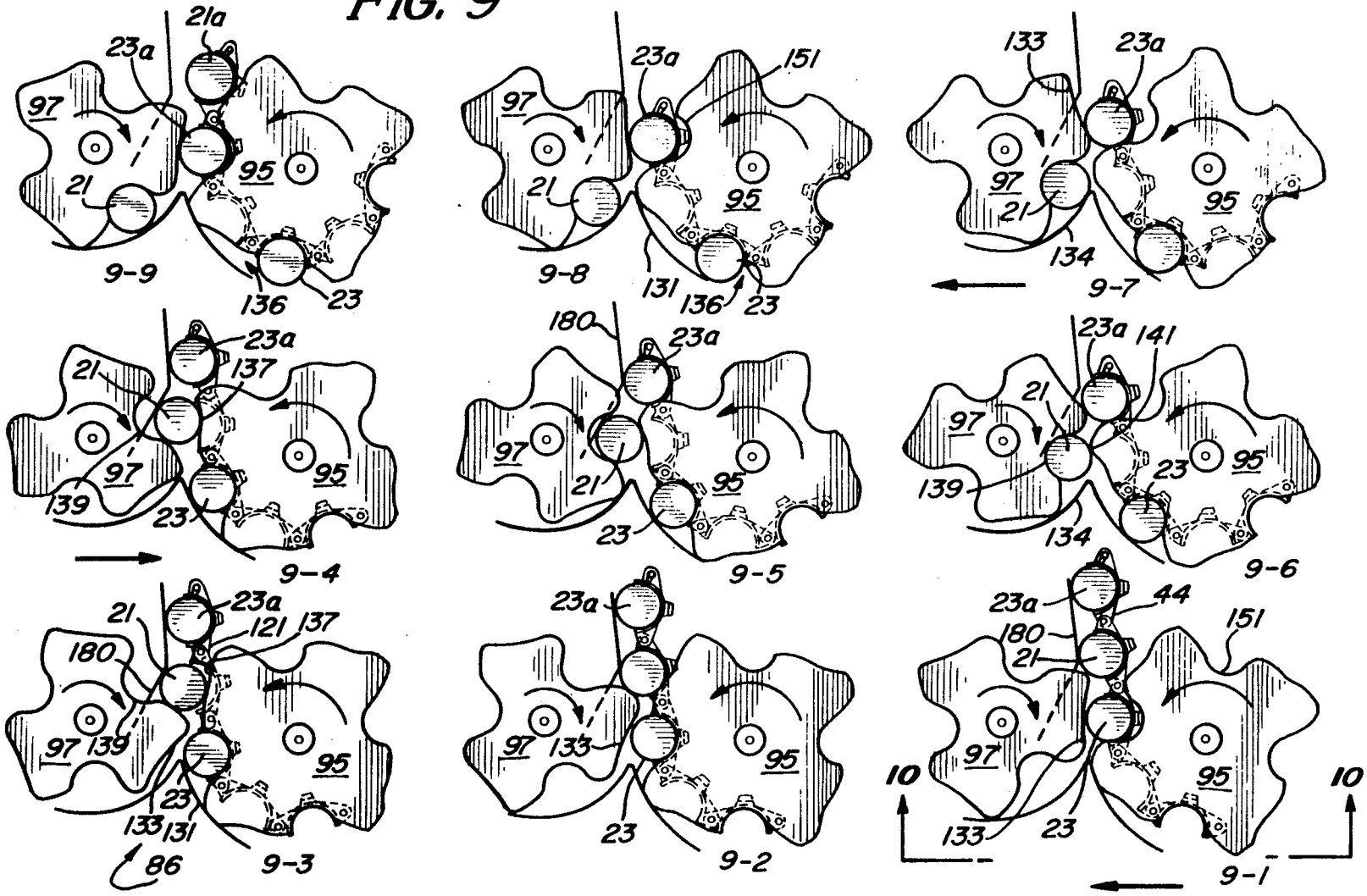
FIG. 9 is a sequential schematic diagram illustrative of the integration of two separate round paths in the preferred embodiment.
Figure 10:
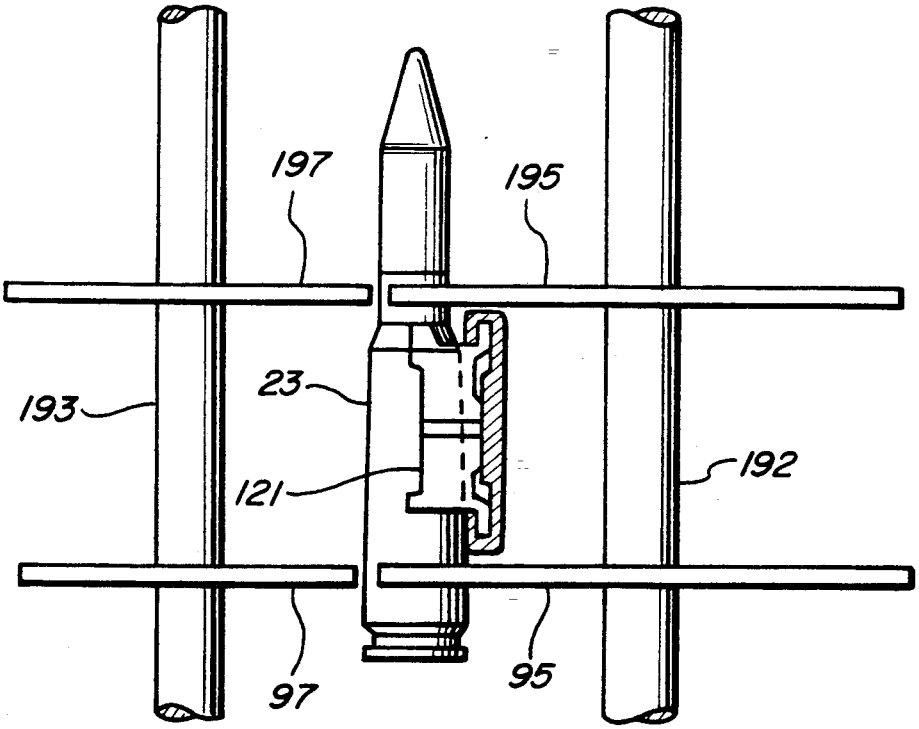
FIG. 10 is a side view of FIG. 9-1.

Referring to FIGS. 8–10, path integrator 17 includes a feed integrator 88 (shown in FIG. 8) for receiving rounds 21, 23 from twister conveyor 102 and a return integrator 86 (shown in FIGS. 9 and 10) for feeding rounds to twister conveyor 104. Feed integrator 88 and path integrator 86 each includes a pair of round control rotors 95, 97. Feed integrator 88 transfers unfired rounds into a conventional conveyor 44, while the return integrator 86 receives spent cases from gun conveyor 44 and transfers them to twister conveyor 104.

The manner in which the pairs of feed and return round control rotors 95, 97 operate will be described in detail in connection with FIG. 9, showing return integrator 86.

In FIG. 9-1, concave surface 133 of rotor 97, one of three identical, contoured, generally concave surfaces on rotor 97 is providing a guide surface for an exemplary round 23. A succeeding round 21 is constrained in a carriage element of gun conveyor 44 by fixed guide 180. In FIG. 9-2, rotor 97 has rotated slightly further clockwise while guide surface 133 still guides and controls round 23. Rotor 95 has rotated further, counterclockwise in synchronism with and at a rotational rate proportional to the ratio of the number of pockets in rotor 97 divided by the number of pockets in rotor 95.

At the point of rotation of rotors 95, 97 shown in FIG. 9-3, rotor 95 has rotated to the point where the end of surface 133 is still slightly touching round 23 and round 23 is entering a fixed guide 131. From this position, i.e., FIGS. 9-4 through 9-8, round 23 is captured by fixed guide 131. In FIG. 9—9, round 23 is transferred into a conveyor element 64 of twister assembly 112 of twister conveyor 104 (not shown in FIG. 9).

Further in FIG. 9-3, round 21 is just beginning to leave its respective carriage element in conveyor 44. More particularly, round 21 is being forced and guided out of the carriage element by guide surface 137 of rotor 95. As shown, guide surface 137 is initially rounded, slopes upward at a first slope, then upward at a second steeper slope, and then is bluntly rounded tangentially. In practice, the contours of guide surface 137 and guide surface 133 are determined by kinematic layout, as known to those skilled in the art. In FIG. 9-3, surface 137 is beginning to displace the round 21 into a pocket 139 in rotor 97, while being further constrained to its prescribed round path by fixed guide 180.

FIGS. 9-4 and 9-5 illustrate the further progression of round 21 out of the conveyor assembly and into element 64 of twister assembly 110 of twister conveyor 104 under the guidance of rotor surface 137. In FIG. 9-6, the "blunt" tangential portion 141 of surface 137 is exerting a guiding force directing the round 21 nearly completely into pocket 139 and an entryway provided by a fixed guide 134.

In FIG. 9-7, round 21 is completely inserted into pocket 139 and is being rotated around a guide 134. At the same time, concave surface 133 of rotor 97 (three identical, contoured, generally concave surfaces), which began contacting the next round 23*a* in FIG. 9-6, is now positively guiding that next round 23*a*.

In FIG. 9-8, round 23 is just about to exit through gap 136 into element 64 of twister assembly 112, while pocket 151 of rotor 95 is beginning to receive round 23*a* and its respective carriage element. Rounds 23 and 23*a* are afforded clearance by pockets 151 in rotor 95, which have a radius which matches that of the rounds 23, 23*a*, and which allow every other round to be transferred by rotor 95 and guide 131.

Finally, in FIG. 9-9, round 23 is in position be handed off to twister assembly 112 of twister conveyor 104.

As may be appreciated, each rotor 95, 97 in the top view of FIG. 3 is paired with a proportionately shaped and identically functioning rotor located beneath it on a conveyor shaft in order to properly support and transfer the rounds of ammunition 21, 23. FIG. 10 is illustrative, depicting a round 23, as well as the round control rotors 95, 97. Each round control rotor 95, 97 is paired with a cooperating round control rotor 195, 197 on respective shafts 192, 193. The rotors 195, 197 function identically to their cooperating rotors 95, 97, the only difference being a proportional enlargement to accommodate the smaller diameter of round 23 at its contact point with rotors 195, 197.

Thus, rounds 21 and 23 are taken from single gun conveyor 44 and separated onto parallel paths for feeding to return twister conveyor 104, which reorients the rounds to a nose-to-nose orientation for final storage in magazine 15.

The integrating rotors operate with equivalent control in either direction, allowing identical units to be employed for separating round paths for the return path conveyors in addition to merging the feed system.

SYSTEM PERFORMANCE

Magazine 15 contains a nominal 500 ready rounds of 20 mm M50 series ammunition and is capable of operating at rates of 4,000 and 6,000 shots per minute. The system is capable of operating with any combination of empty spaces, empty ammunition cases, and/or unfired rounds, and is capable of cycling either a single 20 mm cartridge or a single empty case from one end of the system to the other.

The drive power for magazine 15 and its associated interface mechanisms is derived from conventional existing hydraulic drives which power gun 13. Compatibility with conventional hydraulic drive units provides significant savings in the areas of logistics, maintenance, and training. Adapting the hydraulic drive unit to a new magazine is a simple matter of designing gears to effect the interface, along with the requisite drive shafts and structural adapters.

Linear linkless ammunition containers such as that of the invention are inherently very strong due to a large number of transverse partitions used to guide the ammunition through the system. The outer side skin of magazine 15 is preferably perforated with a pattern of small holes sufficient to provide an adequate venting area.

The estimated empty weight of all the major components of the system is under 150 pounds.

INSTALLED ENVIRONMENT

The ammunition container is installed in an upright position in the aircraft and is accessible from below and through an access door located on the left-hand side of the nose barrel.

A conventional hoisting unit may be utilized to hoist the gun and ammunition feed system into the aircraft as presently accomplished.

Those skilled in the art will appreciate that various adaptions and modifications of the just-described preferred embodiment can be configured without departing from the scope and spirit of the invention. Therefore, it is to be understood that, within the scope of the appended claims, the invention may be practiced other than as specifically described herein.

What is claimed is:

1. An ammunition feed and storage apparatus comprising:

a magazine means for providing first and second series of sequential rounds along a single path, the rounds being provided in alternating opposing orientation;

twister conveyor means for receiving the first and second series of rounds, for aligning the first and second series of rounds, and for conveying the first and second series of rounds onto first and second paths, respectively; and path integrator means for receiving the first and second series of rounds from the twister conveyor means and for integrating the first and second series of rounds into a single third series of rounds wherein the third series of rounds is aligned in common orientation.

2. The ammunition feed and storage apparatus of claim 1, wherein the twister conveying means comprises:

first and second closely adjacent sprockets aligned about the common axis;

third and fourth sprockets provided in spaced relationship from the first and second sprockets nd provided in a plane parallel to and intersecting the common axis of the first and second sprockets;

a first closed conveying chain, carrying individual conveying elements, connected to and carried on the first and third sprockets; and a second closed conveying chain, carrying individual conveying elements, connected to an carried on the second and fourth sprockets, respectively, the individual carrying elements of the first closed conveyor chain receiving only the first series of rounds from the magazine means and conveying them to the path integrator means, the individual conveying elements of the second closed conveyor chain receiving only the second series of rounds from the magazine means and conveying the second series of rounds to the path integrator means, such that the path integrator means receives parallel first and second series of rounds on parallel first and second paths.

3. The ammunition feed and storage apparatus of claim 2, wherein the first and second sprockets are drive sprockets and the third and fourth sprockets are idle sprockets.

4. The ammunition feed and storage apparatus of claim 2, wherein the first and second sprockets are idle sprockets and the third and fourth sprockets are drive sprockets.

5. The ammunition feed and storage apparatus of claim 1, wherein the twister conveyor means comprises:

a first twister assembly means for receiving only the first series of rounds, for rotating the first series of rounds through a first angle, and for conveying the first series of rounds thus rotated onto a first parallel path; and a second twister assembly means for receiving only the second series of rounds, for rotating the second series of rounds through a second angle, and for conveying the second series of rounds thus rotated onto a second parallel path;

the first and second angles being chosen such that the first and second series of rounds is aligned in parallel when conveyed onto the first and second parallel paths.

6. The ammunition feed and storage apparatus of claim 5, wherein the first angle is positive 90 degrees and the second angle is negative 90 degrees.

7. The ammunition feed and storage apparatus of claim 5, wherein the first and second angles differ by 180 degrees.

8. The ammunition feed system of claim 5, wherein the first twister conveying means comprises first and second sprockets, a conveying chain disposed on and carried by the first and second sprockets, individual conveying elements carried on the conveying chain, the conveying elements for sequentially engaging and carrying the first series of rounds from the magazine means, the first and second sprockets having first and second axes, the first and second axes being oriented at perpendicular angles, respectively, such that the first series of rounds conveyed by the conveying elements are rotated through 90 degrees.

9. The ammunition feed and storage apparatus of claim 8, wherein the first sprocket is a drive sprocket and the second sprocket is an idle sprocket.

10. The ammunition feed and storage apparatus of claim 8, wherein the first sprocket is an idle sprocket and the second sprocket is a drive sprocket.

11. The ammunition feed and storage apparatus of claim 8, wherein the first sprocket is disposed adjacent to a feed point of the single path of the magazine means and wherein the axis of the first sprocket is perpendicular to the single path of the magazine means at the feed point.

12. An ammunition feed and storage apparatus, comprising:

a firing apparatus for firing rounds;

a return means for receiving rounds from the firing apparatus and for providing a single series of rounds aligned in parallel;

a path separator means for receiving the single series of rounds and for separating the single series of rounds into first and second series of rounds on first and second paths; and a twister conveyor means for receiving the first and second series of rounds, for rotating the first and second series of rounds, respectively, to dispose of the first and second series of rounds in parallel opposing orientations, and for conveying the first and second series of opposing rounds to a magazine means for storing the first and second series of opposed rounds along a single path, the rounds being stored in alternating opposing orientations.

13. The ammunition feed and storage apparatus of claim 12, wherein the path integrator means comprises a pair of rotor means for integrating rounds received from two paths into the third series of rounds.

14. The ammunition feed and storage apparatus of claim 13, wherein the pair of rotors operate as dynamic rotary round guides.

15. The ammunition feed and storage apparatus of claim 13, wherein each of said pair of rotor means includes a perimeter which contains a plurality of pockets for receiving rounds, each pair of pockets being separated by a surface contoured to guide with alternate rounds being transported in the pocket of the opposing rotor means, whereby said contoured surfaces function as dynamic rotary round guides.

16. An ammunition storage and feed apparatus comprising:

a magazine means for sequentially providing at least one series of uniform rounds along a path, the rounds each having a longitudinal axis and being substantially symmetric about the axis, the rounds being disposed with the longitudinal axes perpendicular to the path, the magazine means including support means for supporting the rounds along the path, the support means bearing against each round at, at least, first and second contact positions, each round having a certain diameter at each contact position, with the contact positions located along the longitudinal axis of each round at locations where said certain diameters are all equal, such that each round is evenly supported by the support means and is rollable along the support means with limited friction, wherein the magazine means provides first and second series of rounds along the path, the first and second series of rounds being provided in alternating opposing orientation, the support means bearing against the rounds at three contact positions, with the first series of rounds supported at first and second contact positions, and with the second series of rounds supported at second and third contact positions, such that both series of round are evenly supported and are rollable along the support means with limited friction.

* * * * *